US005596960A

United States Patent [19]

Hazen

[11] Patent Number: 5,596,960

[45] Date of Patent: Jan. 28, 1997

[54] INTERNAL COMBUSTION ENGINE

[75] Inventor: David J. Hazen, Ann Arbor, Mich.

[73] Assignee: Ford Motor Company, Dearborn, Mich.

[21] Appl. No.: 537,969

[22] Filed: Oct. 2, 1995

[51] Int. Cl.[6] ..... F01L 1/18; F01L 1/24

[52] U.S. Cl. ..... 123/90.44; 123/90.46

[58] Field of Search ..... 123/90.16, 90.39, 123/90.41, 90.44, 90.45, 90.46

[56] References Cited

U.S. PATENT DOCUMENTS

| | | | |
|---|---|---|---|
| 4,104,996 | 8/1978 | Hosono et al. | 123/90.46 |
| 4,711,210 | 12/1987 | Reichenbach | 123/90.46 |
| 4,726,332 | 2/1988 | Nishimura et al. | 123/90.16 |
| 5,031,584 | 7/1991 | Frost | 123/90.16 |

FOREIGN PATENT DOCUMENTS

| | | | |
|---|---|---|---|
| 2039975 | 2/1972 | Germany | 123/90.46 |

OTHER PUBLICATIONS

Eaton Valve Gear Geometry.
1993 Legend Introduction, Honda Motor Co. Car Manual Oct. 1992.
1986 Legend Introduction, Honda Motor Co. Car Manual Feb. 1986.
1995 Park Avenue, General Motors 3.8 V6 Car Manual.
1993 Hyundai Coupe Car Manual, Jun. 1992.
1994 Toyota Corolla Repair Manual, vol. 1.
Infiniti Q45 Model G50 Series Car Manual 1992.
Stealth 1991 Service Manual, vol. 1.
Automotive Technology/A Systems Approach, Delmar Publishers, Inc.
1995 Contour, Mystique, Ford Service Manual.
1995 Windstar Service Manual Supplement, Ford Sep. 1994.

*Primary Examiner*—Weilun Lo
*Attorney, Agent, or Firm*—Neil P. Ferraro

[57] ABSTRACT

A rocker arm for an internal combustion engine is provided with a hydraulic lash adjuster located therein. The rocker arm comprises two portions rotatably mounted relative to each other with the hydraulic lash adjuster located therebetween. The hydraulic lash adjuster compensates for any slack in the valve train and rotates with the rocker arm about the rocker arm's axis of rotation rather than move linearly along the pushrod axis as in prior art systems. As a result, hydraulic lash adjuster wear, valve spring force, engine friction, and fuel consumption may be reduced while not decreasing the valve train toss speed.

8 Claims, 2 Drawing Sheets

INTERNAL COMBUSTION ENGINE

FIELD OF THE INVENTION

The present invention relates to a hydraulic lash adjuster for an internal combustion engine rocker arm for reducing hydraulic lash adjuster wear, valve train mass, and friction, and more particularly, to placing the hydraulic lash adjuster in rocking motion within the rocker arm itself.

BACKGROUND OF THE INVENTION

The intake of the air/fuel mixture and the exhaust of burned gases must be carefully controlled for proper operation of an internal combustion engine. This function is carried out by components associated with the engine's cylinder head and are referred to as the valve train. These components typically include the valves, springs, rocker arms, camshaft, lifters and pushrods among others and are generally located in the cylinder head of the engine.

Generally, as the camshaft rotates, a camshaft lobes pushes against a lifter which, in turn, either directly or through the use of a pushrod, pushes one side of the rocker arm causing the rocker arm to rotate about a mounting pin. The other side of the rocker arm, in turn, pushes on the valve stem allowing the air/fuel mixture and/or exhaust to enter and/or leave the combustion chamber, respectively. As the camshaft continues to rotate, the pushrod follows the curve of the camshaft due to the valve spring force and returns to its initial position. This allows the rocker arm, biased by the valve spring, to rotate in the opposite direction thereby closing the valve to the combustion chamber. This arrangement of components has no means of compensating for slack due to wear of the components in the valve train which, in turn, causes increased wear and noise.

To overcome this, prior art arrangements make use of a hydraulic lash adjuster located between the camshaft and pushrod. Other prior art systems, typically in the case of an overhead camshaft, locate the hydraulic lash adjuster in the rocker arm. The disadvantage to such placement of the hydraulic lash adjuster is that the lash adjuster moves linearly. Because the hydraulic lash adjuster is generally the heaviest component in the valve train, by placing the hydraulic lash adjuster in rocking motion (about the rocker arm's axis of rotation) instead of linear (along the pushrod axis), as in prior art arrangements, the effective valve train mass is reduced thereby reducing valve spring load and valve train friction and reducing hydraulic lash adjuster wear.

SUMMARY OF THE INVENTION

An advantage of the invention is to the placement of a hydraulic lash adjuster within a rocker arm such that the hydraulic lash adjuster rotates about the rocker arm's axis of rotation.

Another advantage of the present invention is to place the hydraulic lash adjuster within the rocker arm so as to reduce wear on the surface of the hydraulic lash adjuster plunger.

Still, another advantage of the present invention is to reduce valve spring force, engine friction, and fuel consumption while not decreasing the valve train toss speed.

According to the invention, there is provided a rocker arm assembly for an internal combustion engine comprising a first rocker arm portion rotatably mounted to a support on said engine thereby providing an axis of rotation, said first rocker arm portion having a surface radially spaced from said axis of rotation for engaging an end of a shaft of said engine; a second rocker arm portion rotatably mounted relative to said first rocker arm portion, said second rocker arm portion being rotated by a cam surface of a camshaft so as to rotate said second rocker arm portion about said axis of rotation; and, a hydraulic lash adjuster disposed between said first and said second rocker arm portions and radially spaced from said axis of rotation such that said first rocker arm portion, said second rocker arm portion and said hydraulic lash adjuster, when in use, rotate about said axis of rotation.

According to the invention there is also provided a valve train arrangement for an internal combustion engine comprising a camshaft having a cam surface, said camshaft being rotatably mounted to said engine; a valve stem slide ably mounted within said engine and having an end; a first rocker arm portion rotatably mounted to a support on said engine thereby providing an axis of rotation, said first rocker arm portion having a surface radially spaced from said axis of rotation for engaging said end of said valve stem; a second rocker arm portion rotatably mounted relative to said first rocker arm portion, said second rocker arm portion being rotated by said cam surface of said camshaft so as to rotate said second rocker arm portion about said axis of rotation; a biasing means for biasing said valve stem relative to said first rocker arm portion; and, a hydraulic lash adjuster disposed between said first and said second rocker arm portions and radially spaced from said axis of rotation such that said first rocker arm portion, said second rocker arm portion and said hydraulic lash adjuster, when in use, rotate about said axis of rotation.

According to the invention there is also provided a method for compensating for slack in an internal combustion engine valve train comprising the steps of rotatably mounting a first rocker arm portion to a support on said engine thereby providing an axis of rotation, said first rocker arm portion having a surface radially spaced from said axis of rotation for engaging an end of a valve stem of said engine; rotatably mounting a second rocker arm portion relative to said first rocker arm portion, said second rocker arm portion being rotated by a cam surface of a camshaft; and, positioning a hydraulic lash adjuster between said first and second rocker arm portions and radially spacing said hydraulic lash adjuster from said axis of rotation such that said first rocker arm portion, said hydraulic lash adjuster, and said second rocker arm portion, when in use, rotate about said axis of rotation.

Other objects, features and advantages of the present invention will be readily appreciated by the reader of this specification.

BRIEF DESCRIPTION OF THE DRAWINGS

The invention will now be described, by of example, with reference to the accompanying drawings, in which.

DETAILED DESCRIPTION OF THE PREFERRED EMBODIMENTS

Figure 1:
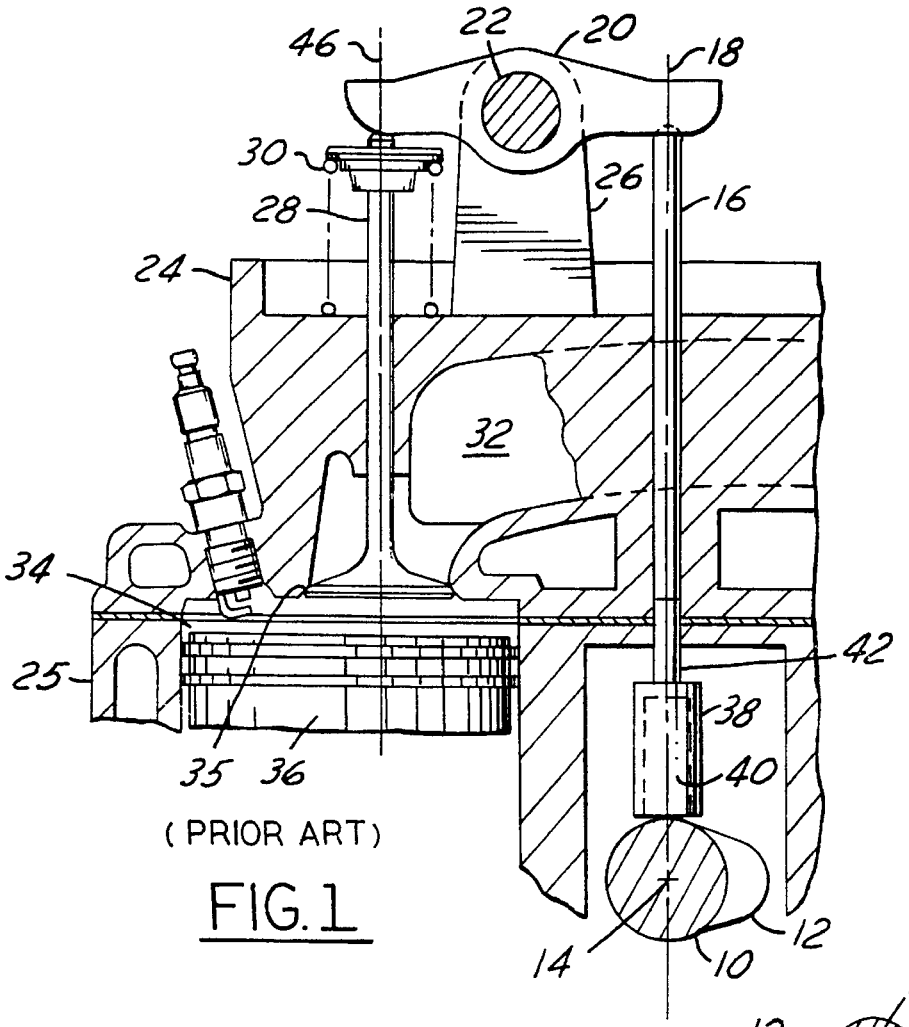
(PRIOR ART) FIG. 1
FIG. 1 a diagrammatic plan view of a first prior art valve train.

Turning first to FIG. 1, there is shown a prior art valve train and a portion of the engine to which the valve train relates. The valve train typically comprises camshaft 10 having lobe 12 and axis 14. Camshaft 10 rotates about axis 14 such that the camshaft surface determines the position of pushrod 16 along its axis 18. For example, when lobe 12 is in a vertical position as viewed in FIG. 1, pushrod 16 moves along its axis 18 to its highest vertical position. Pushrod 16 pushes against one side of rocker arm 20 such that rocker arm 20 rotates about pin 22 in a counter clockwise direction as viewed in FIG. 1. Rocker arm 20 is attached to the cylinder head 24 by way of support 26. Cylinder head 24 is attached to engine block 25. As rocker arm 20 rotates, it pushes against a shaft such as valve 28 (which, together with rocker arm 20, is biased by spring 30) so as to allow channel 32 to communicate with cylinder 34 via valve seat 35. Cylinder 34 houses piston 36. As camshaft 10 continues to rotate, pushrod 16 returns to its initial position thereby allowing valve 28 to block communication between passage 32 and cylinder 34. As is well known, the operation of valve 28 is to allow the air/fuel mixture to enter cylinder 34 or allow exhaust to exit therefrom. In prior art valve trains, hydraulic lash adjuster 38 is disposed between camshaft 10 and pushrod 16. The purpose of hydraulic lash adjuster 38 is to compensate for any slack and to reduce noise in the valve train.

Hydraulic lash adjuster 38 comprises body 40 filled with hydraulic fluid and plunger 42. Once the hydraulic oil is pressurized, plunger 42 moves such that the amount of movement compensates for any slack in the valve train. Further, by utilizing the fluid, hydraulic lash adjuster 38 serves as a noise suppresser. Typically, fluid for hydraulic lash adjuster 38 is supplied to hydraulic lash adjuster body 40 by a fluid supply line (see description with reference to FIGS. 3–5). This allows plunger 42 of hydraulic lash adjuster 38 to continually exert pressure on the valve train and continually compensate for slack. Other prior art systems which do not use a hydraulic lash adjuster require continual maintenance. In these valve trains, a mechanical lash adjuster, typically a screw threaded into the end of the rocker arm 20 adjacent pushrod 16, compensates for any slack. As the components of the valve train wear, the mechanical lash adjuster must be manually adjusted. This is typically performed at regular maintenance intervals.

Figure 2:
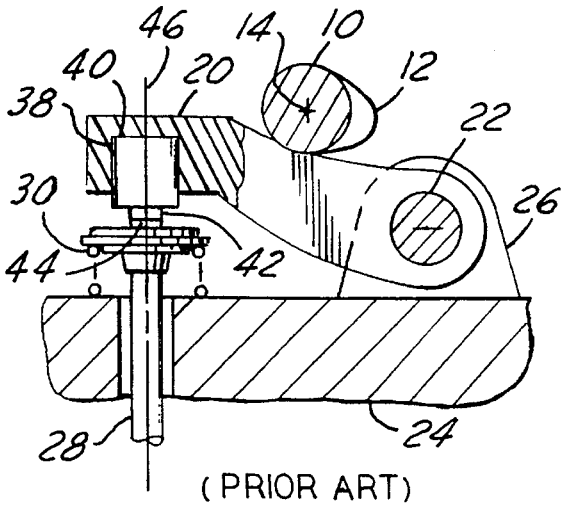
(PRIOR ART) FIG. 2
FIG. 2 is a diagrammatic plan view of a second prior art valve train.

Referring now to FIG. 2, there is shown hydraulic lash adjuster 38 located within rocker arm 20 at valve tip 44. This arrangement is typically used for overhead camshaft engines. Here, camshaft 10 acts on rocker arm 20 directly without the need for pushrod 16. Because there is no pushrod 16, hydraulic lash adjuster 38 is disposed between rocker arm 20 and valve 28. Here, hydraulic lash adjuster 38 is fixed to rocker arm 20 and rotates with rocker arm 20 about pin 22.

An inherent disadvantage to the valve train arrangement as described with reference to FIG. 1, is that hydraulic lash adjuster 38 is disposed to move along axis 18 during camshaft 10 rotation. Due to the high mass of hydraulic lash adjuster 38, a great amount of energy is required to move hydraulic lash adjuster 38 along axis 18. This results in the need for a relatively large sized spring 30 to return the valve train to its initial position. With respect to FIG. 2, although hydraulic lash adjuster 38 rotates about pin 22, there is lateral movement between hydraulic lash adjuster 38 and valve 28 at tip 44. That is, as rocker arm 20 rotates, hydraulic lash adjuster 38 also rotates. Because valve 28 is constrained within cylinder head 24 to move along axis 46, there is lateral movement at the interface between plunger 42 and body 40 of hydraulic lash adjuster 38. This continued rubbing causes plunger 42 to wear, which is undesirable, and places a sideways force on valve 28 increasing valve 28 wear.

According to the present invention, by placing hydraulic lash adjuster 38 close to the center of rotation of and within rocker arm 20, the effective mass of hydraulic lash adjuster 38 may be reduced by as much as 50% while reducing any wear at the tip 45 of plunger 42. That is, the rotational inertia of hydraulic lash adjuster 38, when positioned according to the present invention, is less than the linear inertia of hydraulic lash adjuster 38, when positioned according to the prior art. As a result, hydraulic lash adjuster wear, valve spring force, engine friction and fuel consumption may be reduced while not decreasing the valve train toss speed.

Figure 3:
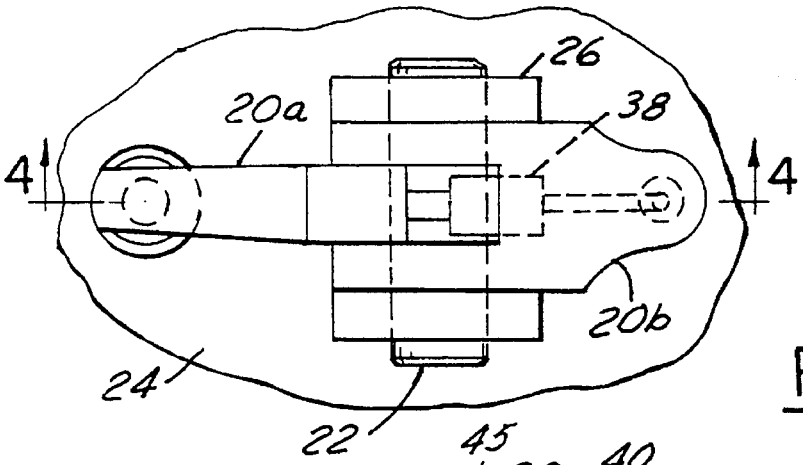
FIG. 3 is a diagrammatic top view of a rocker arm with internal hydraulic lash adjuster of the present invention.
Figure 4:
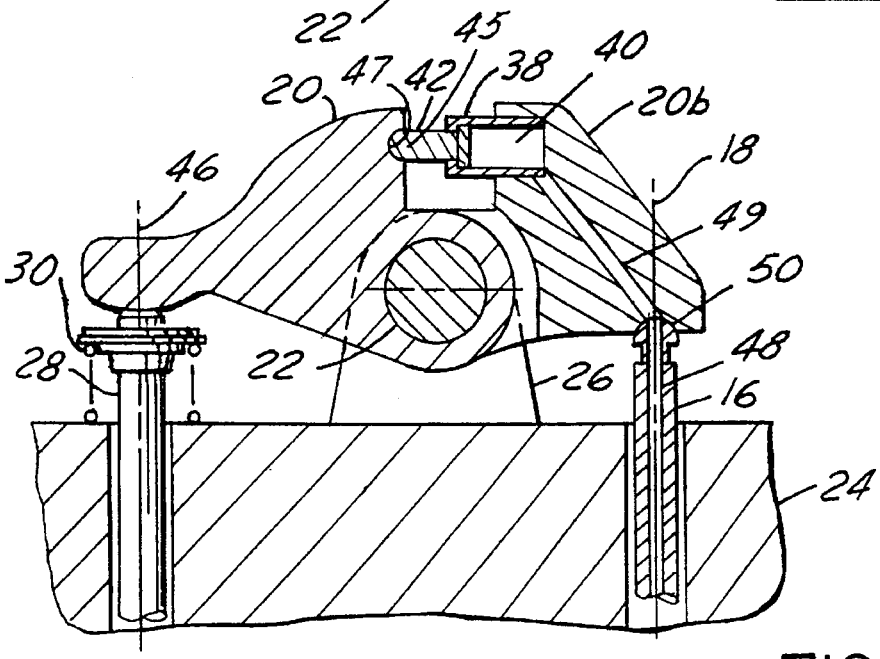
FIG. 4 is a cross section of a rocker arm with internal hydraulic lash adjuster of the present invention taken along line 4—4 of FIG. 3.

Turning now to FIGS. 3 and 4, there is shown hydraulic lash adjuster 38 disposed between rocker arm portions (**20*a* and 20*b*) of rocker arm 20. According to the present invention, tip 45 of plunger 42 is convex and rocker arm portion 20*a* is formed with a concave recess 47 to engage tip 45. Thus, tip 45 is placed substantially in surface contact within recess 47 thereby reducing wear at tip 45. Hydraulic fluid flows from the bored center 48 of pushrod 16, into oil passage 49 and into body 40 of hydraulic lash adjuster 38. Once hydraulic lash adjuster 38 is pressurized, (where the fluid in body 40 pushes against plunger 42 which in turn pushes against rocker arm portion 20*a*) rocker arm portions 20*a* and 20*b* spread apart or rotate in opposite directions about pin 22 thereby compensating for any slack in the valve train. When the slack is compensated, rocker arm portions 20*a* and 20*b* behave as one unit, namely rocker arm 20. As camshaft 10 (not shown) rotates, it pushes pushrod 16 along axis 18. Pushrod 16 pushes against surface 50 of rocker arm 20 so as to rotate rocker arm 20 about pin 22 (which is rotatably mounted to support 26 which in turn is fixed to cylinder head 24) counter clockwise as viewed in FIG. 4. This then causes valve 28, biased by spring 30, to move downward along axis 46 as viewed in FIG. 4 thereby allowing communication between passage 32 (not shown) and cylinder 34 (not shown). Because the hydraulic lash adjuster 38 is located close to the center of rotation of rocker arm 20 and rotates with the rotation of rocker arm 20, the effective mass of hydraulic lash adjuster 38 is reduced as compared to the effective mass when hydraulic lash adjuster 38 moves linearly as described with reference to FIG. 1**.

Figure 5:
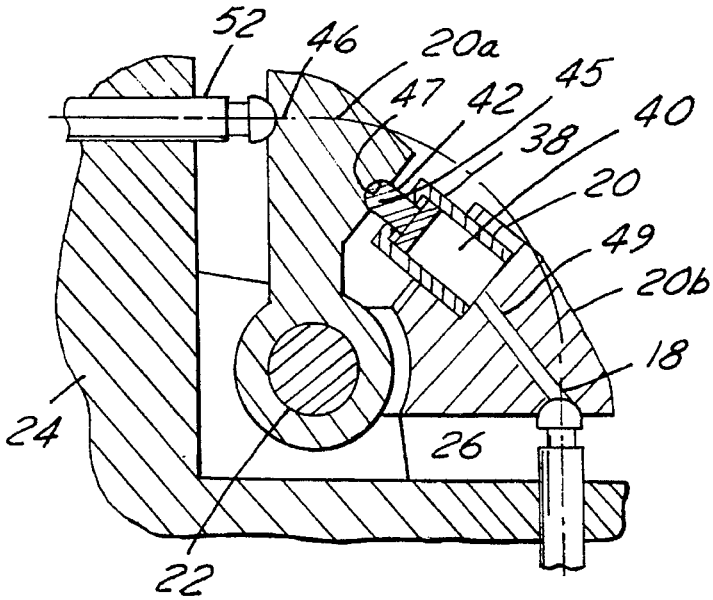
FIG. 5 is a diagrammatic plan view of an alternative embodiment of the present invention; and, FIG. 6 is a diagrammatic plan view of an alternative embodiment of the present invention.

Turning now to FIG. 5, there is shown an alternative embodiment of the present invention for use when a 90° rocker arm is used with cross pushrods. Rocker arm 20 operates in the same manner as described with reference to FIGS. 3 and 4. In particular, as viewed in FIG. 5, as pushrod 16 moves upward along axis 18, rocker arm 20 rotates counter clockwise about pin 22 pushing pushrod 52 to the left. Hydraulic lash adjuster 38 is positioned and operates in the same manner as described with reference to FIGS. 3 and 4. In particular, tip 45 of plunger 42 is convex and rocker arm portion **20*a* is formed with a concave recess 47 to engage tip 45. Thus, tip 45 is placed substantially in surface contact within recess 47 thereby reducing wear at tip 45**.

Fluid from bored center 48 (not shown) of pushrod 16 enters body 40 of hydraulic lash adjuster 38 via oil passage 49. When the fluid is pressurized, plunger 42 of hydraulic lash adjuster 38 pushes against rocker arm portion 20*a* thereby causing rocker arm portions 20*a* and 20*b* to spread apart or rotate in opposite directions. The result is that any slack in the valve train is compensated by hydraulic lash adjuster 38. Further, because hydraulic lash adjuster 38 is located close to the center of rotation of rocker arm 20, as described with reference to FIGS. 3 and 4, the effective mass of hydraulic lash adjuster 38 is reduced when compared to the effective mass of hydraulic lash adjuster 38 as positioned in the valve train of FIG. 1.

Figure 6:
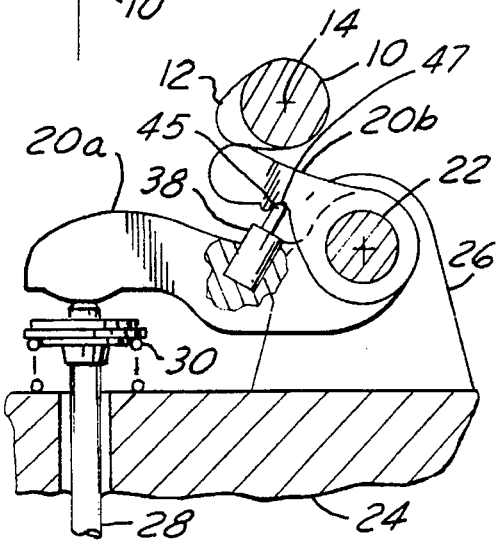

In FIG. 6, there is shown an alternative embodiment of the present invention for use when the valve train is driven by an overhead cam. As described with reference to FIG. 2, although hydraulic lash adjuster 38 is positioned so as to rotate about pin 22, nevertheless, there is excessive wear at plunger 42/body 40 interface and between valve 28 and its guide. To reduce this abrasion, according to the present invention, hydraulic lash adjuster 38 is located within rocker arm 20, as discussed with reference to FIGS. 3, 4 and 5, while maintaining rotational rather than linear movement of hydraulic lash adjuster 38.

While the best mode in carrying out the invention has been described in detail, those having ordinary skill in the art to which this invention relates will recognize various alternative designs and embodiments, including those mentioned above, in practicing the invention that has been defined by the following claims.

I claim:

1. A rocker arm assembly for an internal combustion engine comprising:

a first rocker arm portion rotatably mounted to a support on said engine thereby providing an axis of rotation, said first rocker arm portion having a surface radially spaced from said axis of rotation for engaging an end of a shaft of said engine;

a second rocker arm portion rotatably mounted relative to said first rocker arm portion, said second rocker arm portion being rotated by a cam surface of a camshaft so as to rotate said second rocker arm portion about said axis of rotation; and, a hydraulic lash adjuster disposed within said first and said second rocker arm portions and radially spaced from said axis of rotation such that said first rocker arm portion, said second rocker arm portion and said hydraulic lash adjuster, when in use, rotate about said axis of rotation, with said hydraulic lash adjuster comprising:

a fluid filled body fixed relative to one of said first and second rocker arm portions; and, a plunger reciprocally housed within said body, with said plunger having a substantially convex tip engaging one of said first and second rocker arm portions in a substantially concave recess formed therein such that said convex tip of said plunger is placed substantially in surface contact within said substantially concave recess.

2. The rocker arm assembly according to claim 1 wherein said second rocker arm portion is rotated by said cam surface of said camshaft via a pushrod.

3. The rocker arm assembly according to claim 1 wherein said hydraulic lash adjuster, when in use, tends to rotate said first rocker arm portion in an opposite direction from said second rocker arm portion about said axis of rotation.

4. The rocker arm assembly according to claim 1 wherein said shaft is a valve stem.

5. The rocker arm assembly according to claim 1 wherein said shaft is a pushrod.

6. A valve train arrangement for an internal combustion engine comprising:

a camshaft having a cam surface, said camshaft being rotatably mounted to said engine;

a valve stem slideably mounted within said engine and having an end;

a first rocker arm portion rotatably mounted to a support on said engine thereby providing an axis of rotation, said first rocker arm portion having a surface radially spaced from said axis of rotation for engaging said end of said valve stem;

a second rocker arm portion rotatably mounted relative to said first rocker arm portion, said second rocker arm portion being rotated by said cam surface of said camshaft so as to rotate said second rocker arm portion about said axis of rotation;

a biasing means for biasing said valve stem towards said first rocker arm portion; and, a hydraulic lash adjuster disposed within said first and said second rocker arm portions and radially spaced from said axis of rotation such that said first rocker arm portion, said second rocker arm portion and said hydraulic lash adjuster, when in use, rotate about said axis of rotation, with said hydraulic lash adjuster comprising:

a fluid filled body fixed relative to one of said first and second rocker arm portions; and, a plunger reciprocally housed within said body, with said plunger having a substantially convex tip engaging one of said first and second rocker arm portions in a substantially concave recess formed therein such that said convex tip of said plunger is placed substantially in surface contact within said substantially concave recess.

7. The valve train arrangement according to claim 6 wherein said hydraulic lash adjuster, when in use, tends to rotate said first rocker arm portion in an opposite direction from said second rocker arm portion about said axis of rotation.

8. The valve train arrangement according to claim 6 wherein said second rocker arm portion is rotated by said cam surface of said camshaft via a pushrod.

* * * * *